US008141534B2

(12) United States Patent
Liu et al.

(10) Patent No.: US 8,141,534 B2
(45) Date of Patent: Mar. 27, 2012

(54) METHODS AND SYSTEMS FOR ASSISTED DIRECT START CONTROL

(75) Inventors: Xiangying Liu, Ann Arbor, MI (US); Henry W. Patterson, Waterford, MI (US); Joseph Norman Ulrey, Dearborn, MI (US); Alex O'Connor Gibson, Ann Arbor, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 53 days.

(21) Appl. No.: 12/699,583

(22) Filed: Feb. 3, 2010

(65) Prior Publication Data

US 2011/0132308 A1 Jun. 9, 2011

(51) Int. Cl.
*F02D 45/00* (2006.01)
*F02N 11/08* (2006.01)

(52) U.S. Cl. ..... 123/179.4

(58) Field of Classification Search ..... 123/179.3, 123/179.4; 701/112, 113
See application file for complete search history.

(56) References Cited

U.S. PATENT DOCUMENTS

| | | | | |
|---|---|---|---|---|
| 0,645,865 | A | 3/1900 | Mallory et al. | |
| 4,362,133 | A | 12/1982 | Malik | |
| 6,161,640 | A | 12/2000 | Yamaguchi | |
| 6,278,195 | B1 | 8/2001 | Yamaguchi et al. | |
| 6,556,910 | B2 | 4/2003 | Suzuki et al. | |
| 6,651,603 | B2 | 11/2003 | Osada et al. | |
| 6,672,267 | B2 * | 1/2004 | Souki et al. | 123/179.3 |
| 6,730,000 | B1 | 5/2004 | Leising et al. | |
| 6,736,755 | B2 | 5/2004 | Kato | |
| 6,763,903 | B2 | 7/2004 | Morimoto et al. | |
| 6,834,632 | B2 | 12/2004 | Kataoka et al. | |
| 6,848,552 | B2 | 2/2005 | Miller | |
| 6,857,491 | B2 | 2/2005 | Wakashiro et al. | |
| 7,066,128 | B2 | 6/2006 | Satake et al. | |
| 7,103,468 | B2 | 9/2006 | Wakashiro et al. | |
| 7,134,414 | B2 | 11/2006 | Ries-Mueller et al. | |
| 7,159,561 | B1 | 1/2007 | Kerns et al. | |
| 7,191,755 | B2 | 3/2007 | Vint | |

(Continued)

FOREIGN PATENT DOCUMENTS

DE 19934111 A1 * 1/2001

(Continued)

OTHER PUBLICATIONS

Urley, Joseph Norman et al., "Methods and Systems for Assisted Direct Start Control," U.S. Appl. No. 12/692,455, filed Jan. 22, 2010, 33 pages.

*Primary Examiner* — Stephen K Cronin
*Assistant Examiner* — Arnold Castro
(74) *Attorney, Agent, or Firm* — Allan J. Lippa; Alleman Hall McCoy Russell & Tuttle LLP

(57) ABSTRACT

Methods and systems are provided for controlling a vehicle system including an engine that is selectively deactivated during engine idle-stop conditions. One example method includes, during a first condition, engaging an engine starter, without applying a starter current, to the deactivated rotating engine after the engine speed drops below a threshold speed. The method further includes, during a second condition, engaging the starter and adjusting a starter motor switch to apply a starter braking torque to the rotating engine.

18 Claims, 6 Drawing Sheets

U.S. PATENT DOCUMENTS

| | | | | |
|---|---|---|---|---|
| 7,218,010 | B2 * | 5/2007 | Albertson et al. | 290/38 R |
| 7,247,123 | B2 | 7/2007 | Ohtake et al. | |
| 7,275,509 | B2 | 10/2007 | Kassner | |
| 7,305,300 | B2 | 12/2007 | Gibson et al. | |
| 2003/0209373 | A1 | 11/2003 | Egami et al. | |
| 2006/0048734 | A1 | 3/2006 | Kataoka et al. | |
| 2007/0006831 | A1 | 1/2007 | Leone et al. | |
| 2007/0192018 | A1 | 8/2007 | Gibson et al. | |
| 2007/0209618 | A1 | 9/2007 | Leone | |
| 2007/0209619 | A1 | 9/2007 | Leone | |
| 2009/0020091 | A1 | 1/2009 | Botzenhard et al. | |
| 2010/0101522 | A1 * | 4/2010 | Ge et al. | 123/179.3 |
| 2010/0174473 | A1 | 7/2010 | Pursifull et al. | |

FOREIGN PATENT DOCUMENTS

| | | | |
|---|---|---|---|
| EP | 0848159 | A1 | 6/1998 |
| JP | 11082088 | | 3/1999 |
| JP | 2001193540 | | 7/2001 |
| JP | 2003214210 | | 7/2003 |
| JP | 2005009430 | A1 * | 1/2005 |
| JP | 2007315316 | | 12/2007 |

* cited by examiner

METHODS AND SYSTEMS FOR ASSISTED DIRECT START CONTROL

FIELD

The present application relates to methods and systems for controlling an engine shutdown and a subsequent engine restart.

BACKGROUND AND SUMMARY

Vehicles have been developed to perform an idle-stop when idle-stop conditions are met and automatically restart the engine when restart conditions are met. Such idle-stop systems enable fuel savings, reduction in exhaust emissions, reduction in noise, and the like.

Engines may be restarted from the idle-stop condition automatically, without receiving an operator input, for example, in response to engine operating parameters falling outside a desired operating range. Alternatively, engines may be restarted from the idle-stop condition in response to a vehicle restart and/or launch request from the operator. In some instances, a driver may have a change of mind while the engine is being shut down (e.g., still spinning down) and may wish to immediately restart the engine. To restart the vehicle, the driver may have to wait for the engine rotation to decrease (for example, completely stop) before the engine starter can be re-engaged. As such, this may substantially increase the restart time and thus degrade the quality of the restart operation. Additionally, if the starter is re-engaged at low engine speeds, the engagement may occur during the reverse rotation of the engine, leading to shutdown shake and audible noise.

One example approach to reduce engine restart times is illustrated by Kassner in U.S. Pat. No. 7,275,509. Herein, an engine starter is engaged during shutdown when the engine is in a pre-specified speed range and predefined rotational direction. By adjusting the timing of the engaging signal, starter engagement during engine reverse rotation is reduced.

However, the inventors have recognized potential issues with such a system. As one example, engine starter engagement is delayed until the engine speed is within the pre-specified range and the engine rotational direction is in the forward direction of the crankshaft. Thus, Kassner's approach reduces the engagement of the starter during engine reverse rotation, but neither addresses engine reverse rotation at spin-down, nor reduces engine spin-down times. Further still, Kassner's approach requires engine tracking to determine the direction of engine rotation.

Thus, in one example, some of the above issues may be addressed by a method of controlling a vehicle system including an engine that is selectively deactivated during engine idle-stop conditions. In one embodiment, the method comprises, during a first condition, engaging an engine starter, without applying a starter current, to the deactivated rotating engine after the engine speed drops below a threshold speed; and during a second condition, engaging the starter and adjusting a starter motor switch to apply a starter braking torque to the rotating engine.

In one example, an engine may be operated with a starter system comprising a starter, a battery or capacitor-operated starter motor, one or more starter gears including a pinion gear, and a one-way over-run clutch. In response to idle-stop conditions, the engine may be deactivated (that is, fuel and spark may be shut off) and may start spinning to rest. During a first condition, after the engine has dropped below a threshold speed (for example, below 200 rpm), the engine starter may be engaged to the deactivated rotating engine without applying a starter current. Specifically, the starter pinion gear may be engaged to the rotating engine, irrespective of whether a restart has been requested or not. Additionally, engine reverse rotations during the spin-down may be substantially stopped via the one-way clutch of the starter. As such, when the starter motor is engaged via the one-way clutch, engine reverse rotation would require the starter motor to accelerate and rotate while back-driving through the starter gearset. Thus engine reverse rotation may be impeded. By the use of prevailing torques, the gearset's back-drive efficiency can be made very low, thereby providing a substantial drag. Furthermore, by shorting the motor the back-EMF voltage may provide an "electric" braking torque.

In one example, the threshold speed may be assigned based on the starter model and pinion gear geometry so that the engagement of the starter to the engine may be performed at above-zero engine speeds without objectionable noise behavior. During a second condition, with the starter already engaged, the starter motor switch may be adjusted to apply an additional starter braking torque to the deactivated rotating engine to further expedite engine spin-down. The starter braking torque may be selected based on engine operating conditions, and may be adjusted using starter motor control. For example, the starter braking torque may be applied by grounding the starter motor switch (for example, shorting the two motor terminals of a relay to each other), or by opening a starter motor circuit. Consequently, if a restart is requested while the engine is still spinning down (for example, in response to a sudden driver change of mind), the starter may already be in an engaged state and a rapid restart may be executed by applying a starting voltage (for example, from a battery or a capacitor) to the starter motor switch to crank the engine and initiate combustion in the cylinders.

In this way, by engaging the starter and selectively applying a starter braking torque to the spinning engine during engine spin-down, irrespective of whether a restart is anticipated or not, an engine spin-down may be expedited enabling a swift engine restart without first bringing the engine to a complete stop. However, it will be appreciated that if a prior engine full stop is desired (for example, as determined by the driver, or by the engine controller), a restart may alternatively be performed only after fully stopping the engine, but again while keeping the starter engaged and optionally using the starter braking torque to rapidly slow the engine to rest. Thus, the time required for restarting an engine may be reduced and a swift restart in response to a driver change of mind can be supported. Additionally, by engaging the starter gear and via the one-way clutch, engine reverse rotation may be substantially reduced (or effectively eliminated), thereby improving engine position determination at restart. Further, starter engagement related shutdown shake and objectionable engagement grinding noises may also be reduced. As such, the overall quality of engine restarts may be improved.

Further still, by expediting engine shutdown, an amount of air (or excess oxygen) pumped through the catalyst at shutdown may be reduced (where the excess oxygen may be stored in the catalyst), thereby reducing the amount of fuel needed to condition the catalyst during the subsequent engine restart and react with the stored oxygen. As such, this may provide additional fuel economy benefits.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
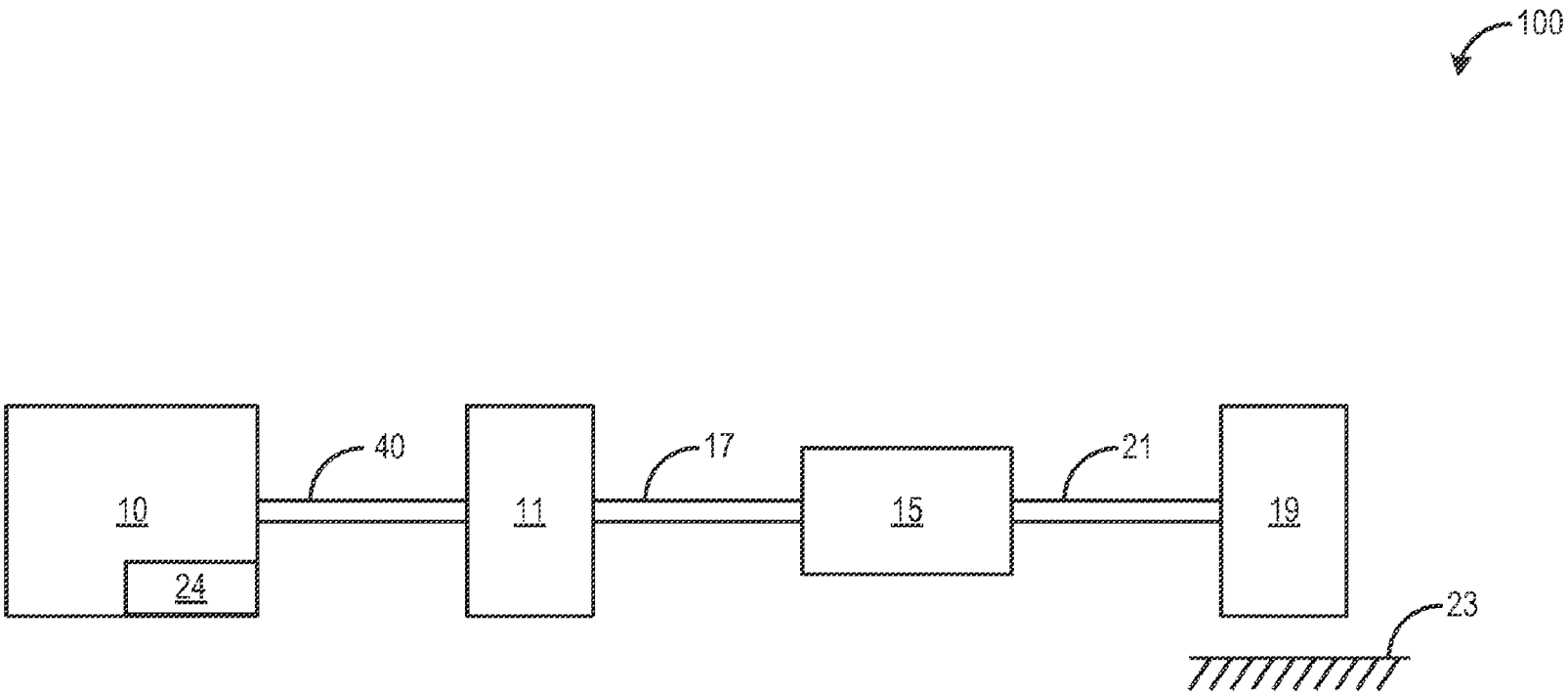
FIG. 1 shows an example vehicle system layout, including details of a vehicle drive-train.
Figure 2:
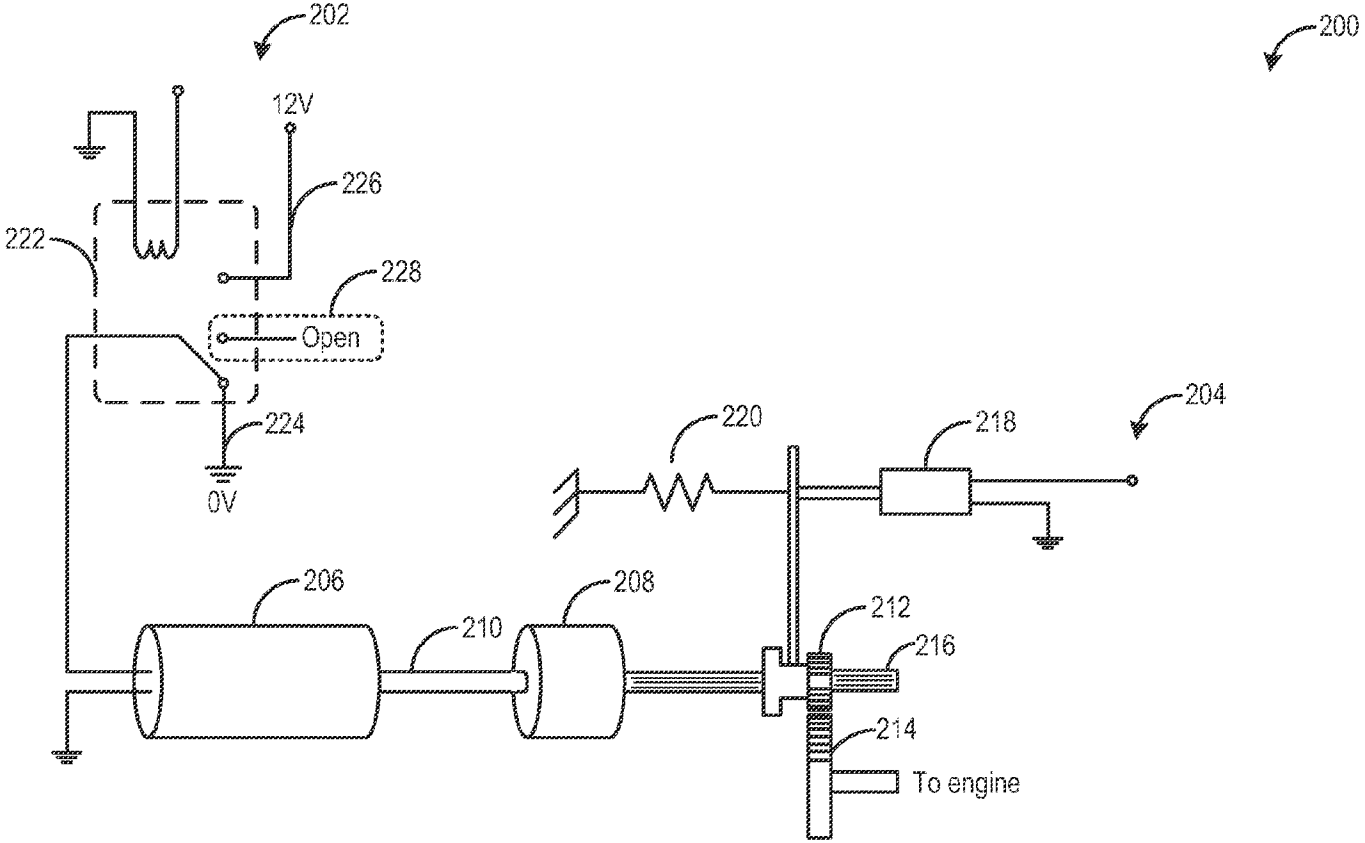
FIG. 2 shows an example embodiment of the starting system of FIG. 1.
Figure 3:
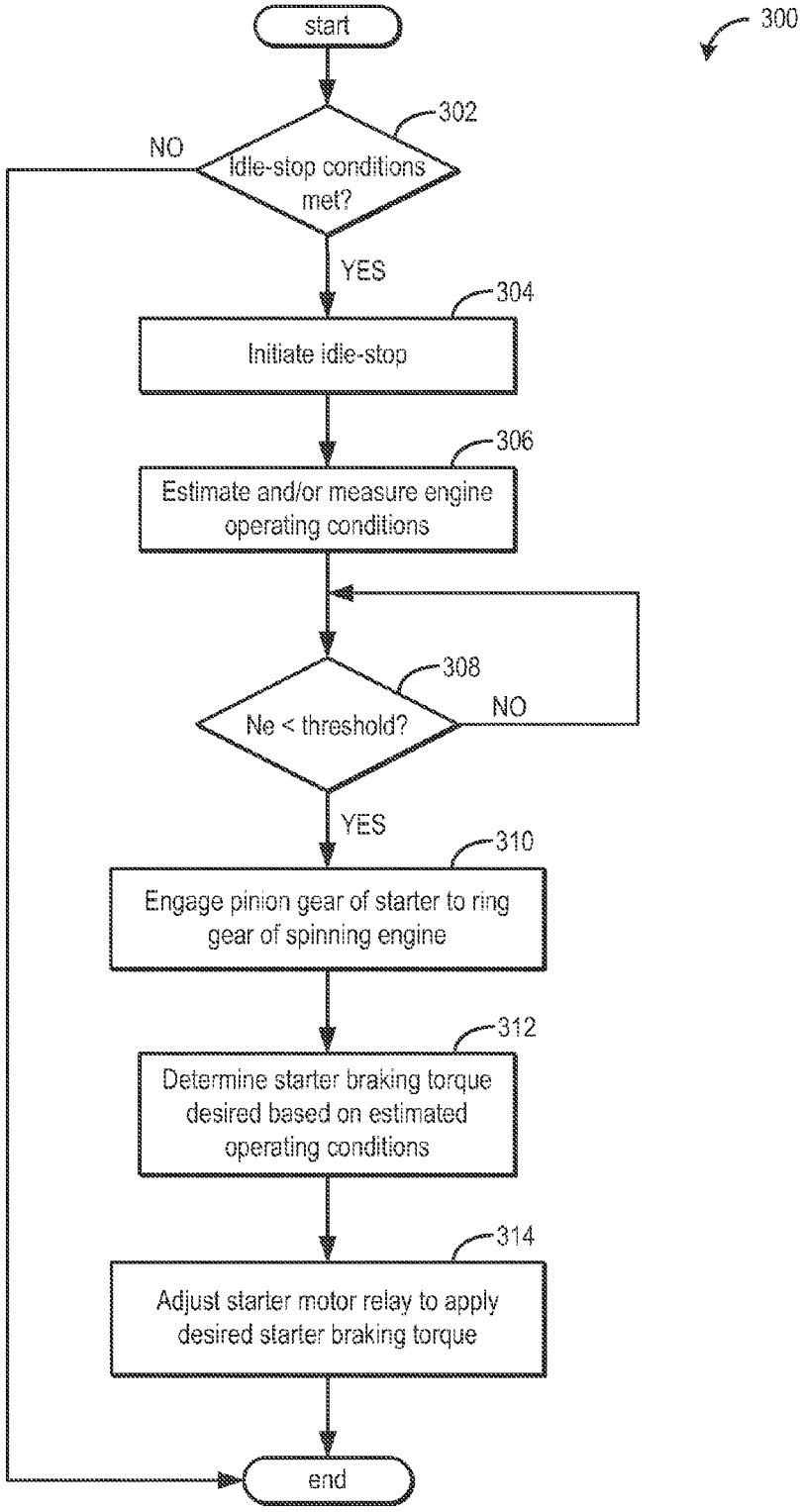
FIG. 3 shows a high level flow chart for executing an idle-stop operation with starter engagement, according to the present disclosure.
Figure 4:
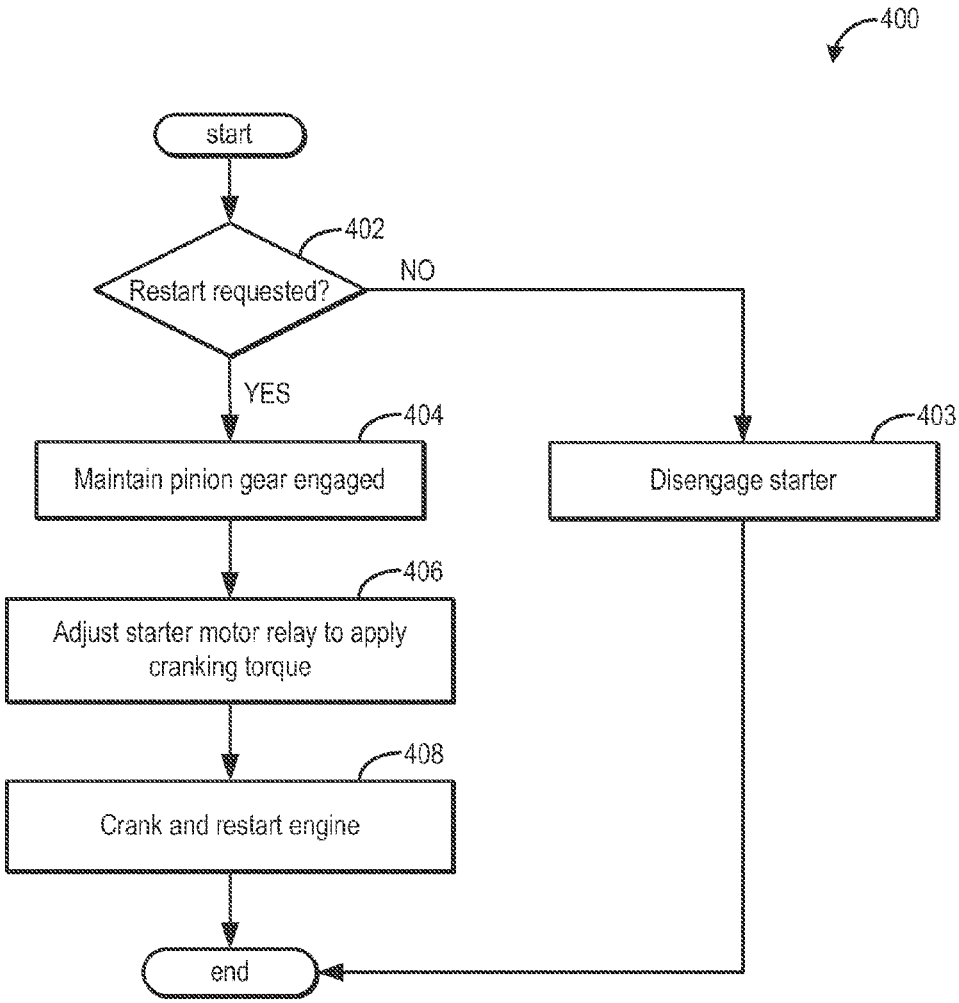
FIG. 4 shows a high level flow chart for executing a restart operation, according to the present disclosure.

The following description relates to systems and methods for expediting engine spin-down and reducing reverse rotation during an engine idle-stop. As shown in FIGS. 1-2, an engine starting system may be configured with a starter motor and a starter gear train. During an idle-stop operation, a starter gear may be engaged to the spinning engine to reduce engine reversals and expedite engine spin-down. Further, engine reverse rotation may be substantially stopped via a one-way clutch in the starter. Based on engine operating conditions, a starter motor switch, such as a starter motor relay, may be adjusted to apply an additional starter braking torque to further assist engine spin-down and reduce acceleration delays during subsequent engine restarts. The starter gear engagement and starter braking torque may enable the engine speed to be rapidly lowered to at least a predetermined starter threshold speed (or to rest) wherefrom an engine restart may rapidly ensue. A controller may be configured to perform control routines, such as shown in FIGS. 3-4, to engage the starter gear to the spinning engine after the engine speed has dropped below a threshold. Then, based on an amount and timing of a desired starter braking torque, the controller may adjust the position of a starter motor relay between a ground position (or open position) and a motoring (e.g., battery) position and/or adjust an amount of braking voltage applied across the relay. In response to a restart requested during the spin-down, since the starter is already engaged, a starter voltage may be applied across the relay to provide a cranking torque. In this way, as further elaborated in FIGS. 5-7, engine reverse rotation may be addressed, an engine spin-down may be expedited, and acceleration delays at restart can be significantly reduced.

FIG. 1 shows a vehicle system 100 including internal combustion engine 10 coupled to torque converter 11 via crankshaft 40. Engine 10 may be a gasoline engine. In alternate embodiments, other engine configurations may be employed, for example a diesel engine. Engine 10 may be started with an engine starting system 24, including a starter, and one or more starter gears. In one example, the starter may be motor-driven (e.g. battery-driven or capacitor driven). In another example, the starter may be a powertrain drive motor, such as a hybrid powerplant connected to the engine by way of a coupling device. The coupling device may include a transmission, one or more gears, and/or any other suitable coupling device. The starter may be configured to support engine restart at low non-zero engine speeds, such as, for example at or below 50 rpm. Alternatively, the engine may be restarted in a low speed range, for example between 50 to 100 rpm. Alternatively, the engine may be restarted in a higher speed range, for example above 200 rpm. As elaborated herein, starting system 24 may be used to expedite engine spin-down during an idle-stop operation. Specifically, starter gear engagement control may be used to engage a pinion gear of the starter to the rotating deactivated engine while a one-way clutch reduces engine reverse rotation. Additionally, starter motor control may be employed to adjust an amount of starter braking torque that is applied on the rotating engine to bring it towards rest. By engaging the starter even before a restart is requested, the engine can be cranked and restarted faster during the subsequent restart.

Torque converter 11 is also coupled to transmission 15 via turbine shaft 17. Torque converter 11 has a bypass clutch (not shown) which can be engaged, disengaged, or partially engaged. When the clutch is either disengaged or being disengaged, the torque converter is said to be in an unlocked state. Turbine shaft 17 is also known as a transmission input shaft. In one embodiment, transmission 15 comprises an electronically controlled transmission with a plurality of selectable discrete gear ratios. Transmission 15 may also comprises various other gears, such as, for example, a final drive ratio (not shown). Alternatively, transmission 15 may be a continuously variable transmission (CVT).

Transmission 15 may further be coupled to tire 19 via axle 21. Tire 19 interfaces the vehicle (not shown) to the road 23. Note that in one example embodiment, this power-train is coupled in a passenger vehicle that travels on the road. While various vehicle configurations may be used, in one example, the engine is the sole motive power source, and thus the vehicle is not a hybrid-electric, hybrid-plug-in, etc. In other embodiments, the method may be incorporated into a hybrid vehicle.

Now turning to FIG. 2, a detailed example embodiment 200 of the starting system of FIG. 1 is illustrated. The starting system may include a starter motor 206 coupled to a starter gear train 208 via shaft 210. The starter gear train 208 may be configured with a plurality of gears to enable torque multiplication through one or more gear ratios. The starting system may further include a pinion gear 212 along a splined shaft 216. Starter gear engagement control 204 may be used to engage pinion gear 212 to ring gear 214 of the engine crankshaft. Starter gear engagement control 204 may include a pull solenoid 218 and a pull spring 220. In response to an engaging signal, pull solenoid 218 may be activated. Pull solenoid activation may draw pull spring 220 towards the solenoid, while also drawing pinion gear 212 towards ring gear 214, enabling gear engagement. As such, by engaging pinion gear 212 to ring gear 214, starter motor torque may be transferred to the crankshaft to rotate the engine and begin a combustion cycle. As elaborated with reference to FIG. 3, an engine controller may be configured to provide an engaging signal during every idle-stop operation, once the engine speed has dropped below a threshold speed (for example, below 200 rpm), irrespective of whether a subsequent restart is requested or not, to expedite engine spin-down. Pinion gear 212 may further include a one-way over-run clutch (not shown). Alternatively, the one-way clutch may be housed in gear train 208. The one way clutch may enable the engine to over-run the starter. When pinion gear 212 is engaged, one-way clutch may apply as soon as the engine starts to reverse rotate, thereby reducing engine reversals at spin-down. In this way, the starter may be engaged at engine idle-stop without applying a starter motor current.

Starter motor 206 may be operated using starter motor control 202 including starter motor switch 222. Switch 222 may be selected from a variety of switches for controlling the operation of starter motor 206. In one example, as illustrated herein, starter motor switch 222 may be a starter motor relay. However, it will be appreciated that in alternate embodiments, starter motor switch 222 may be a transistor, a mechanical switch, a solid state switch, etc. In one example, a common switch may be used to operate both the starter motor 206 and pull solenoid 218. In another example, the starter motor and pull solenoid may each be operated by dedicated switches. As such, starter motor switch 222 may be shifted between at least a ground position 224 (that is, shorted) by applying a ground voltage (0V), and a cranking (or motoring) position 226 by applying a motor voltage (for example, 12V). The motor voltage may be provided by a battery and/or capacitor. In alternate embodiments, starter motor switch 222 may optionally include a third open position 228 (dotted lines). When the switch is in third open position 228, the starter motor may have less resistance to angular motion than it has when shorted in the ground position (i.e. with electrical braking). Thus, with the starter pinion gear engaged, when starter motor switch 222 is in ground position 224, a larger braking torque may be applied on the rotating engine, and a larger reduction of engine reverse rotation may be achieved. In comparison, when starter motor switch 222 is in open position 228, a smaller braking torque may be applied on the rotating engine, and a smaller reduction of engine reverse rotation may be achieved. In contrast, when the starter pinion gear is disengaged, a large spin-down angle may be achieved with substantially no reduction in engine reversals. When starter motor switch 222 is in cranking position 226, no braking torque may be applied and engine acceleration may ensue.

In this way, by including multiple positions in the switch, at least two levels of decelerating torque may be available to expedite engine spin-down. Furthermore, by adjusting between the positions, an amount of decelerating torque may be adjusted. For example, an amount of braking torque applied may be adjusted by varying the switch position between the ground position 224 and the open position 228. In another embodiment, additional switch positions may be included, such as positions with various resistors to the ground. By including a resistor to ground position, an intermediate braking torque may be achieved. Further, during the engine idle-stop, braking torque modulation may be achieved by adjusting the position of the switch between the ground position, the resistor to ground position, the open position and/or the cranking position. Similarly, during an engine restart, cranking torque modulation may be achieved by adjusting the position of the switch between the ground position, the resistor to ground position, the open position and/or the cranking position.

In one example, starter motor switch 222 (or switch) may be shifted to cranking position 226 upon receiving a cranking signal, for example, at engine restart. In another example, the starter motor switch 222 (or switch) may be shifted to the ground position 224 at restart once engine cranking is completed and combustion has initiated in the engine cylinders. In yet another example, as elaborated herein with reference to FIGS. 3-4, during an engine idle-stop, with the starter pinion gear engaged, the starter motor control may be used to adjust a starter braking torque that is applied on the rotating engine to further expedite engine spin-down. Specifically, based on an amount and timing of braking torque desired, the starter motor switch may be grounded.

Now turning to FIG. 3, an example routine 300 is depicted for executing an idle-stop operation with starter engagement, and optionally further applying a starter braking torque, to expedite engine spin-down.

At 302, it may be confirmed that idle-stop conditions have been met. This may include confirming that the engine is operating (e.g., carrying out combustion), the battery state of charge is above a threshold (e.g., more than 30%), vehicle running speed is within a desired range (e.g., no more than 30 mph), an air-conditioner compressor has sufficient air pressure, engine temperature (for example, as inferred from an engine coolant temperature) is above a threshold, a throttle opening degree is less than a threshold, driver requested torque is less than a predetermined threshold value, brake pedal has been pressed, etc. If any or all of the idle-stop conditions are met, then at 304, the controller may initiate execution of the idle-stop operation and proceed to deactivate the engine. As such, this may include shutting off fuel and/or spark to the engine, and stopping combustion in the engine cylinders. However, if idle-stop conditions are not met, the routine may end.

At 306, engine operating conditions during the idle-stop may be estimated and/or measured. These may include estimating engine speed, valve timing, cam timing, barometric pressure, altitude, an amount of aircharge trapped in the cylinders, etc. At 308, it may be determined whether engine speed (Ne) is below a predetermined threshold, for example, below 200 rpm. After the engine speed has dropped below the threshold speed, at 310, an engine starter gear may be engaged to the deactivated rotating engine without applying a starter current. Specifically, the starter pinion gear may be engaged to the ring gear of the spinning engine, for example, by activating a pull solenoid of the starter gear engagement control. In another example, this may include activating a switch controlling the pull solenoid. By engaging the starter gear on every engine spin-down, even when a subsequent restart is not anticipated, or has not been requested, engine reverse rotation may be reduced while expediting engine spin-down. Further, in the event of engine reverse rotation, the one-way clutch of the starter gear may engage and reverse rotation may be reduced.

In one example, the threshold speed below which the starter gear is engaged may be assigned based on audible sound criteria. That is, the threshold may be selected such that the engagement of the starter gear at low (non-zero) engine speeds does not give rise to objectionable noise behavior. In one example, a starter gear may be engaged with normal sound at above-zero engine speeds, such as at 100 rpm. Further, if additional sound is permitted, the starter may be engaged when the engine speed is higher, for example, between 100-200 rpm. Engagement at still higher speeds (such as between 200-500 rpm, or above 500 rpm) may lead to abutment noises or objectionable grinding noises. As such, the noise behavior of the starter may depend on the model of the starter and the geometry of the corresponding starter pinion gear relative to the crankshaft ring gear. Thus, in one example, additional ring gear chamfers may be introduced to reduce the abutment and/or grinding noises experienced. In this way, based on the starter model, a starter gear may be engaged to the engine at low, non-zero, engine speeds without generating objectionable noise.

At 312, a starter braking torque may be determined based on the estimated operating conditions. That is, based on the estimated engine operating conditions including engine speed, cylinder aircharge, valve timing, cam timing, and barometric pressure, an additional starter braking torque may be adjusted. In one example, no starter braking torque may be desired and the engine may spin down with only the starter pinion gear engaged. In another example, a starter braking torque may be desired and the engine may spin down with the starter pinion gear engaged and with starter motor control. If starter braking torque is desired, an amount and timing of the braking torque may also be adjusted based on the estimated engine operating conditions. This may include, for example, determining a braking torque profile based on engine speed, time since starter gear engagement, subsequent restart request time, etc. The amount and timing of starter braking torque application may also be coordinated with the engagement of the starter gear. In one example, the starter braking torque may be initiated after a predetermined duration since starter engagement. In another example, the starter braking torque may be initiated once engine speed has dropped to a determined level following starter gear engagement. In still another example, the starter braking torque may be determined before the starter gear is engaged, and the determined braking torque may be applied at the time of starter gear engagement.

In one example, an engine restart request may be received during the engine spin-down, and while the engine is still rotating, due to a driver change of mind (COM). For example, a first COM restart may be requested during the spin-down at a time when the starter gear is already engaged and the engine speed is low enough that the engine may be restarted immediately, or within a threshold amount of time since the restart request. Consequently, an additional starter braking torque may not be desired. Alternatively, a smaller braking torque may be desired. In another example, a second COM restart may be requested during the spin-down at a time when the starter gear is already engaged but the engine speed is high enough that the engine may not be restarted immediately, and may need more than the threshold amount of time since the restart request. Consequently, an additional starter braking torque may be desired. Alternatively, a larger (than the first example) braking torque may be desired.

The amount and timing of applying the braking torque may also be adjusted based on estimated engine operating conditions. Thus, in one example, adjusting an amount of starter braking torque based on engine operating conditions may include, increasing an amount of braking torque when the engine speed at starter engagement is higher and decreasing an amount of braking torque when the engine speed at starter engagement is lower. Similarly, adjusting the timing of applying the starter braking torque may include, advancing a braking torque timing (that is, a starting time of braking torque application) towards starter engagement when the engine speed at starter engagement is higher, and retarding braking torque timing away from starter engagement when the engine speed at starter engagement is lower. Additionally, or optionally, adjusting the timing of applying braking torque may include adjusting a duration of braking torque application. For example, the adjustment may include increasing the duration of braking torque application when the engine speed at starter engagement is higher, and reducing the duration of braking torque application when the engine speed at starter engagement is lower.

While the above example illustrates adjusting starter braking torque based on engine speed, it will be appreciated that in alternate embodiments, the amount and/or timing of starter braking torque application may be selected or adjusted based on an amount of aircharge in the cylinders, valve and/or cam timing, a desired engine position at the time of engine restart, etc. In one example, adjusting the timing of braking torque application based on a subsequent restart request may include, advancing a timing of starter braking torque application towards starter engagement when a restart is requested closer to, and/or before, starter engagement, and retarding the timing away from starter engagement when the restart is requested further from, and/or after, starter engagement.

Figure 5:
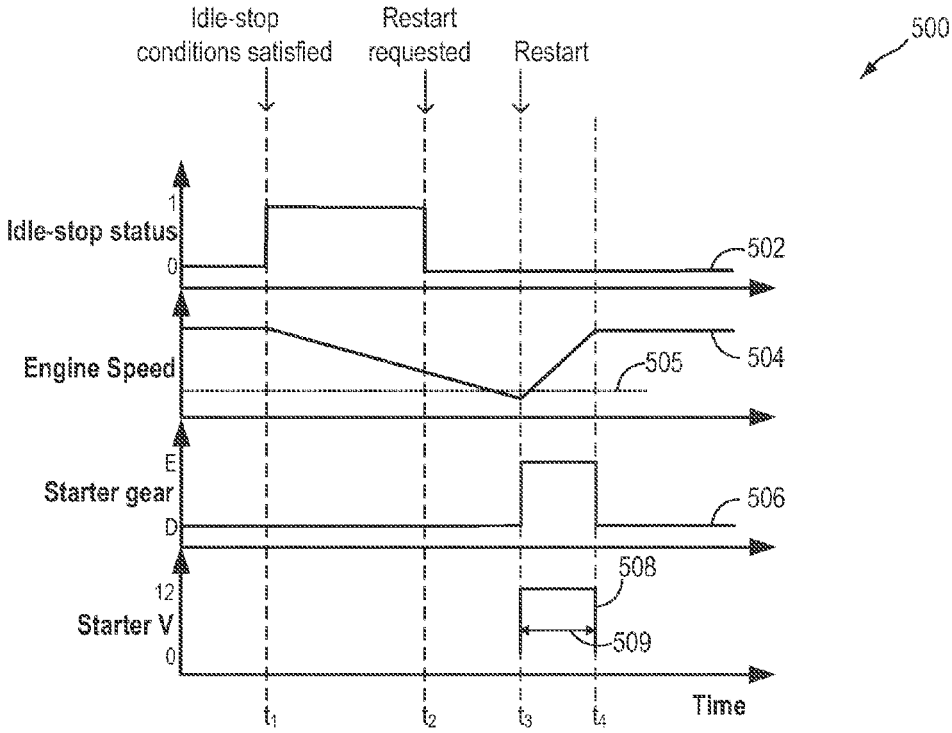
FIGS. 5-7 show maps with a plurality of graphs illustrating example engine idle-stop and restart procedures with starter engagement and/or starter braking torque.
Figure 6:
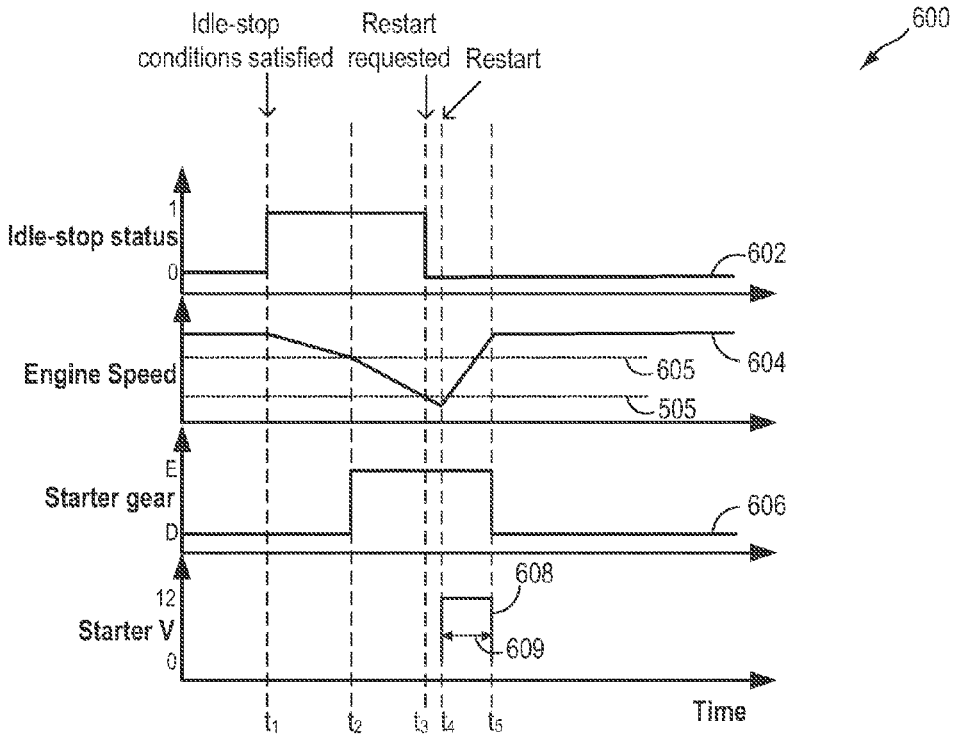
Figure 7:
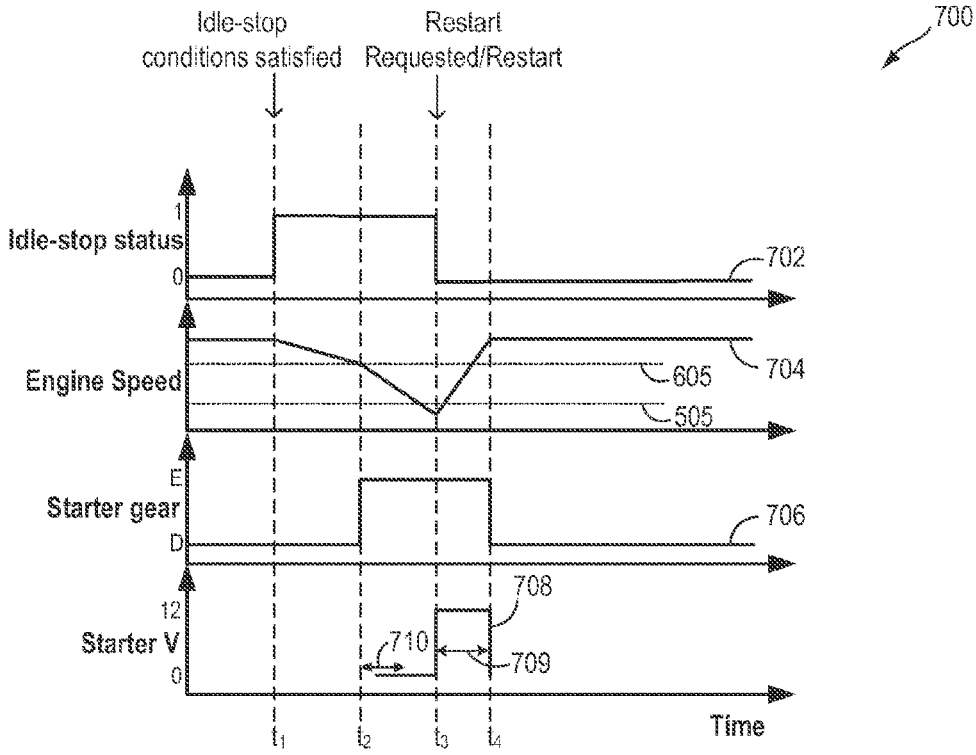

In one example, as illustrated in FIGS. 5-7, the braking torque profile may include the application of a full braking torque (e.g., 0V in this example) at spin-down, and a full cranking torque (e.g., 12V in this example) at restart. In alternate examples, the amount of braking torque applied during spin-down and/or the amount of cranking torque applied during spin-up, may be modulated (for example, modulated responsive to time and/or engine speed). Thus, in one example, based on the starter braking torque profile, a corresponding starter motor switch position profile may also be determined. This may include determining when, and for how long, the switch will be positioned at a ground position (0V), a cranking position (12V), a resistor to ground position (e.g., 0-12V range), and/or an open position. Alternatively, the starter motor switch may be coupled to a pulse width modulator (PWM) and the duty cycle of the PWM may be adjusted by the engine controller based on the requested amount of braking torque.

At 314, the starter motor switch may be adjusted to apply the desired starter braking torque. In one example, adjusting the starter motor switch to apply the desired braking torque may include grounding the starter motor switch (that is, applying 0V). As such, since the starter is geared, the braking motor torque may have significant multiplication. In another example, adjusting the starter motor switch may include opening the starter motor circuit. Herein, the braking torque may be provided by the starter motor's frictional and inertial torques, multiplied by the gear ratio.

In this way, a starter may be engaged on engine spin-down and a starter braking torque may be applied to reduce engine reversals and expedite engine spin-down during idle-stop.

Now turning to FIG. 4, an example routine 400 is depicted for executing a restart operation following the idle-stop with starter engagement. At 402, it may be confirmed that an engine restart and/or vehicle re-launch has been requested. In one example, an operator engine restart request may be received during a preceding idle-stop operation while the engine is still rotating and is not yet stopped. In another example, an engine restart may be automatically requested, without input from an operator, in response to engine conditions falling outside a predetermined range.

If no restart is requested, and/or anticipated, then after the engine has come to a complete stop, at 403, the starter may be disengaged. This may include, for example, deactivating the pull solenoid of the starter gear engagement control to disengage the starter pinion gear from the engine. In another example, this may include deactivating a switch controlling the pull solenoid. By deactivating the pull solenoid and disengaging the starter when no restart is requested or anticipated, electrical energy may be conserved and fuel savings may be achieved. As such, when a restart is subsequently requested, the application of a starter current may be slightly delayed until the starter gear has engaged.

If a restart is requested, then at 404, the starter pinion gear that was engaged during the preceding idle-stop operation may be maintained in the engaged state. At 406, with the starter already engaged and the engine still spinning down, the starter motor switch may be adjusted to apply a cranking torque on the engine. As such, the cranking torque may be a non-braking torque that aids the engine to come up to speed, following which, combustion may resume in the engine cylinders. In one example, the cranking torque may be first applied at a non-zero engine speed. That is, the engine may be cranked only after the engine has dropped below a minimum speed. In an alternate embodiment, the cranking torque may be applied only after the engine has come to a full stop. Adjusting the starter motor switch to apply the cranking torque may include commanding a battery voltage (for example, 12V) to the starter motor switch. Alternatively, if the starter motor is capacitor-powered, a capacitor voltage may be commanded. Further still, if a modulated amount of cranking torque is desired (for example, modulated responsive to engine speed, and/or time), the starter motor switch position may be adjusted between the ground position (0V), the cranking position (12V), the resistor to ground position (e.g., 0-12V range), and/or the open position. Additionally, or optionally, the cranking torque may be modulated by adjusting the duty cycle of a PWM, coupled to the starter motor switch, based on the desired amount of cranking torque. At 408, the engine may be cranked to start rotating the engine until the engine can be reactivated (that is, spark and fuel injection can be restored) and combustion can resume in the cylinders.

FIGS. 5-7 depict maps 500-700 with a plurality of graphs depicting example engine shutdown and restart scenarios for further explaining the various engine shutdown and restart operations of the present disclosure.

FIG. 5 depicts a restart operation following an engine idle-stop without starter engagement or starter braking torque. In FIG. 5, map 500 indicates engine idle-stop status in graph 502. Graph 504 depicts the engine speed profile responsive to the idle-stop and restart operations. Graph 506 represents the engagement status of a starter gear while graph 508 depicts a starter motor switch voltage.

At $t_1$, and as shown by graph 502, an idle-stop request may be confirmed (for example, by confirming idle-stop conditions) and an idle-stop operation may be initiated. Accordingly, engine speed (as depicted by graph 504) may start to drop as the engine spins down. A driver restart request, such as a change of mind (COM) restart request, may be received during the idle-stop operation at $t_2$, while the engine is spinning down Herein, an engine restart may not be possible until the engine speed is at or below a minimum engine speed 505. In one example, the minimum engine speed may be 50 rpm. In another example, the engine restart may not be possible until the engine has come to a full stop. Consequently, an immediate engine restart may not be achievable. That is, a restart operation may only be initiated at $t_3$, once the engine speed has at least dropped below the minimum engine speed 505. Thus, at $t_3$, the starter gear may be engaged (as depicted by graph 506) and a battery voltage (12V) may be applied to the starter motor switch (as depicted by graph 508) to apply a non-braking, cranking torque on the engine. The battery voltage may be applied for a duration 509 until the engine restart is completed at $t_4$ and combustion has resumed. As such, this may increase the restart time (for example, by more than 150 ms) when compared to restart operations following an idle-stop with starter engagement (as further elaborated in FIGS. 6-7).

Now turning to FIG. 6, an engine idle-stop operation with starter engagement, and a subsequent engine restart is depicted. Herein, at $t_1$, and as shown by graph 602, an idle-stop request may be confirmed and an idle-stop operation may be initiated. Accordingly, engine speed (as depicted by graph 604) may start to drop as the engine spins down. At $t_2$, when the engine speed has dropped below a predetermined threshold speed 605, even without receiving an engine restart request, the starter gear may be engaged, as depicted by graph 606. By engaging the starter gear to the still rotating engine, the time required to bring the engine to the predetermined minimum engine speed 505 (or to a full stop) may be reduced. Consequently, in response to a restart requested during the engine spin-down, at $t_3$, the engine may be restarted soon thereafter at $t_4$. Specifically, since the starter is already engaged, the subsequent restart operation can be initiated by simply commanding a battery voltage (12V) to the starter motor switch at $t_4$ and cranking the engine. As such, since the starter is already engaged, the starting voltage may be applied for a shorter duration 609, and consequently, the engine restart may be completed by $t_5$.

Now turning to FIG. 7, an engine restart following an engine idle-stop operation with starter engagement and starter braking torque is depicted. Herein, at $t_1$, and as shown by graph 702, an idle-stop request may be confirmed and an idle-stop operation may be initiated. Accordingly, engine speed (as depicted by graph 704) may start to drop as the engine spins down. At $t_2$, when the engine speed has dropped below threshold speed 605, even without receiving an engine restart request, the starter gear may be engaged, as depicted by graph 706. Additionally, a starter braking torque may be applied at $t_2$ by shorting the starter motor switch (as depicted by graph 708). That is, a ground voltage, 0V, may be commanded to the switch. The timing of applying the starter braking torque, that is, starter switch shorting (as depicted at 710), may be coordinated with starter gear engagement based on engine operating conditions. Thus, in one example, the starter motor braking torque may be initiated concomitant with the starter gear engagement (that is, closer to $t_2$). In another example, the starter motor braking torque may be initiated after starter gear engagement (that is, relatively closer to $t_3$). The delay in braking torque application may include, for example, applying the starter braking torque after a predetermined time duration following starter gear engagement. Alternatively, the delay may include applying the starter braking torque after starter gear engagement has brought engine speed down to a predefined threshold. The starter switch may be shorted until the engine speed has at least dropped below the minimum speed 505 wherefrom it may be restarted rapidly, for example, as depicted, until $t_3$.

By engaging the starter gear to the spinning engine, and applying a starter motor braking torque, the time required to bring the engine to the minimum engine speed 505 (or to a full stop) may be reduced. Consequently, in response to a restart requested at $t_3$ when the engine is not yet stopped, the engine may be immediately restarted. Specifically, since the starter is already engaged, the subsequent restart operation can be initiated by switching the switch to a battery voltage at $t_3$ and cranking the engine. As such, since the starter is already engaged, the starting voltage may be first applied for a shorter duration 709, and consequently, the engine restart may be completed by $t_4$.

While the examples of FIGS. 5-7 illustrate the application of a full braking torque (that is, 0V) at spin-down, and a full cranking torque (that is, 12V) at restart, it will be appreciated that in alternate embodiments, a variable braking torque may be applied during spin-down and/or a variable cranking torque may be applied during spin-up. By varying the amount of braking torque applied, the speed and timing of the engine spin-down to the minimum speed (or to rest) may be adjusted. In one example, the speed and timing may be adjusted so that the engine may be restarted at a desired engine position. The variable braking torque and/or cranking torque may be applied by varying the starter voltage (for example, between 0 and 12V). This may include, for example, varying the position of the starter motor switch between the ground position (0V), the cranking position (12V), a resistor to ground position (e.g., 0-12V range), and/or the open position to attain the desired variable starter voltage. Alternatively, the starter motor switch may be coupled to a pulse width modulator (PWM) and the duty cycle of the PWM may be adjusted by the engine controller to provide a starter voltage corresponding to the requested amount of braking torque and/or cranking torque.

In this way, engine spin-down may be expedited and acceleration delays during subsequent restarts may be reduced. Further, a change of mind based engine restart may be rapidly executed without requiring that the engine reach zero engine speed, if so desired. By engaging the starter during each spin-down, and expediting engine deceleration by applying a starter motor braking torque, the engaged starter can be immediately actuated when a restart is requested, thereby enabling a rapid restart and vehicle launch.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of controlling a vehicle system including an engine that is selectively deactivated during engine idle-stop conditions, comprising:

during a first condition, engaging an engine starter, without applying a starter current, to the deactivated rotating engine after the engine speed drops below a threshold speed;

during a second condition, engaging the starter and adjusting a starter motor switch to apply a starter braking torque to the deactivated rotating engine; and reducing engine reverse rotation via a one-way clutch in the starter.

2. The method of claim 1, wherein adjusting the starter motor switch to apply a braking torque includes grounding the starter motor switch or opening a starter motor circuit.

3. The method of claim 1, wherein adjusting the starter motor switch to apply a braking torque includes varying a position of the starter motor switch at least between each of a ground position, a cranking position, and an open position.

4. The method of claim 1, further comprising, during an engine restart, with the engine still rotating, adjusting the starter motor switch to apply a cranking torque.

5. The method of claim 4, wherein the cranking torque is first applied at a non-zero engine speed.

6. The method of claim 4, wherein adjusting the starter motor switch to apply a cranking torque includes varying a position of the starter motor switch at least between each of a ground position, a cranking position, and an open position.

7. The method of claim 1, wherein an amount of braking torque is adjusted based on engine operating conditions including an engine speed, cylinder aircharge, valve timing, cam timing, and barometric pressure.

8. The method of claim 7, wherein the adjustment includes, increasing an amount of braking torque when the engine speed at starter engagement is higher, and decreasing an amount of braking torque when the engine speed at starter engagement is lower.

9. The method of claim 7, wherein a timing of applying braking torque is also adjusted based on the engine operating conditions.

10. The method of claim 9, wherein the adjustment includes, advancing a timing of braking torque application towards starter engagement when the engine speed at starter engagement is higher, and retarding the timing away from starter engagement when the engine speed at starter engagement is lower.

11. The method of claim 9, wherein the timing is further adjusted based on a subsequent restart request wherein the further adjustment includes, advancing a timing of braking torque application towards starter engagement when the restart is requested before starter engagement, and retarding the timing away from starter engagement when the restart is requested after starter engagement.

12. A method of controlling a vehicle system including an engine that is selectively deactivated during engine idle-stop conditions, comprising, engaging an engine starter gear, without applying a starter current, to the deactivated rotating engine after the engine speed drops below a threshold speed;

with the starter gear engaged, adjusting a starter motor switch to apply a starter braking torque to the rotating engine; and stopping engine reverse rotation via a one-way clutch in the starter.

13. The method of claim 12, wherein the adjustment includes grounding the starter motor switch.

14. The method of claim 12, wherein an amount and/or timing of braking torque is adjusted based on engine operating conditions including engine speed, cylinder aircharge, valve timing, cam timing, barometric pressure, and/or based on a restart request time.

15. The method of claim 14, wherein the adjustment includes, increasing an amount of braking torque and/or advancing a timing of braking torque when the engine speed at starter engagement is higher; and decreasing an amount of braking torque and/or retarding a timing of braking torque when the engine speed at starter engagement is lower.

16. The method of claim 12, further comprising, during an engine restart from idle-stop, with the engine still rotating, applying a battery voltage to the starter motor switch to provide a cranking torque to the engine.

17. A vehicle system, comprising:

an engine having a starter, the starter including a starter motor, a starter gear, a starter motor switch, and a one-way clutch; and a control system configured to, deactivate the engine during engine idle-stop conditions;

engage the starter gear, without applying a starter current, to the deactivated rotating engine after the engine drops below a threshold speed; and following starter gear engagement, ground the starter motor switch to apply a braking torque to the still rotating engine.

18. The system of claim 17, wherein the control system is further configured to, selectively restart the engine in response to an operator engine restart request, the restart request received during a preceding idle-stop operation where the engine is not yet stopped, wherein selectively restarting the engine includes, applying a battery voltage to the starter motor switch to crank the engine.

* * * * *